US008181277B1

(12) United States Patent
Choi

(10) Patent No.: US 8,181,277 B1
(45) Date of Patent: May 22, 2012

(54) BASIC FORM FOR RYALL CAPS

(76) Inventor: Insook Choi, Billerica, MA (US)

( * ) Notice: Subject to any disclaimer, the term of this patent is extended or adjusted under 35 U.S.C. 154(b) by 127 days.

(21) Appl. No.: 11/827,152

(22) Filed: Jul. 9, 2007

(51) Int. Cl.
*A42B 1/04* (2006.01)

(52) U.S. Cl. ..... 2/171; 2/410; 2/209; 5/636

(58) Field of Classification Search ..... 2/171.2, 2/171, 183, 69; 128/207.11
See application file for complete search history.

(56) References Cited

U.S. PATENT DOCUMENTS

| | | | | | |
|---|---|---|---|---|---|
| 2,044,521 | A * | 6/1936 | Weiland et al. | ..... | 132/274 |
| 2,255,708 | A * | 9/1941 | Laughton | ..... | 132/274 |
| 2,367,459 | A * | 1/1945 | Corley | ..... | 2/209 |
| 2,508,631 | A * | 5/1950 | Woodside | ..... | 132/274 |
| 2,533,526 | A * | 12/1950 | Snyder | ..... | 606/204.35 |
| 2,546,842 | A * | 3/1951 | Yealdhall | ..... | 2/425 |
| 2,665,427 | A * | 1/1954 | Street et al. | ..... | 2/195.7 |
| 2,671,446 | A * | 3/1954 | Mann | ..... | 606/204.35 |
| 2,696,007 | A * | 12/1954 | Larkin et al. | ..... | 2/171 |
| 2,698,944 | A * | 1/1955 | Ramsby | ..... | 2/174 |
| 2,983,925 | A * | 5/1961 | Gettinger | ..... | 2/204 |
| 2,996,724 | A * | 8/1961 | Rose et al. | ..... | 2/171 |
| 3,213,466 | A * | 10/1965 | Gettinger | ..... | 2/171.01 |
| 3,561,455 | A * | 2/1971 | Gregg | ..... | 132/274 |
| 3,613,118 | A * | 10/1971 | Raymond | ..... | 2/209.7 |
| 5,920,909 | A * | 7/1999 | Ellsworth et al. | ..... | 2/171 |
| 6,189,151 | B1 * | 2/2001 | Curtis | ..... | 2/171 |
| 6,735,783 | B2 * | 5/2004 | Phillips | ..... | 2/202 |
| 7,225,811 | B2 * | 6/2007 | Ruiz et al. | ..... | 128/207.11 |
| 7,428,763 | B2 * | 9/2008 | Hightower | ..... | 5/636 |
| 2006/0082205 | A1 * | 4/2006 | Hobson | ..... | 297/393 |
| 2006/0090247 | A1 * | 5/2006 | Cho | ..... | 2/209.3 |
| 2008/0189863 | A1 * | 8/2008 | Zappas | ..... | 5/636 |

* cited by examiner

*Primary Examiner* — Katherine Moran
*Assistant Examiner* — Richale Quinn
(74) *Attorney, Agent, or Firm* — John H. Pearson, Jr., Esq.; Walter F. Dawson, Esq.; Pearson & Pearson, LLP

(57) ABSTRACT

A sleeping cap for lifting the face of a person away from a sleeping surface to prevent facial wrinkles comprises a U-shaped basic form covered with a fabric and having first and second extensions, each of the extensions being flexibly positioned within the fabric adjacent to each leg end of the U-shaped basic form, and the fabric covering the end of the first extension is attached to the fabric at the end of the second extension to form the sleeping cap. Straps from each side of the sleeping cap secure the cap on the person's head.

4 Claims, 4 Drawing Sheets

FIG. 2A
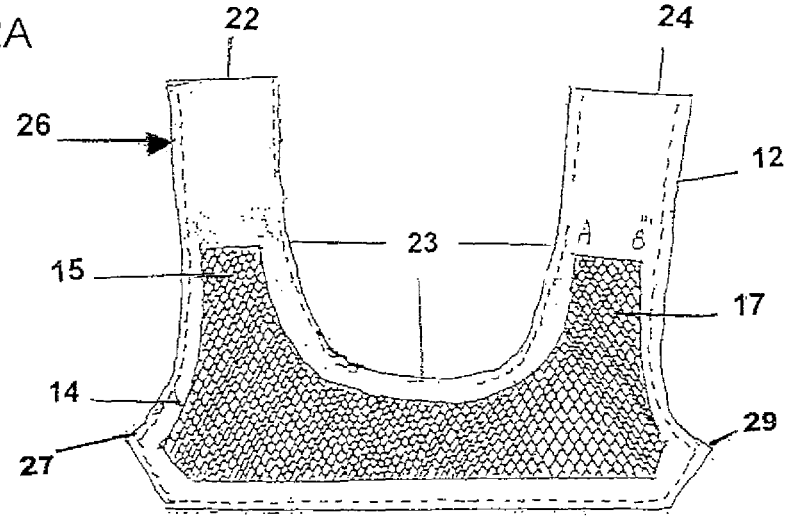
FIG. 2B
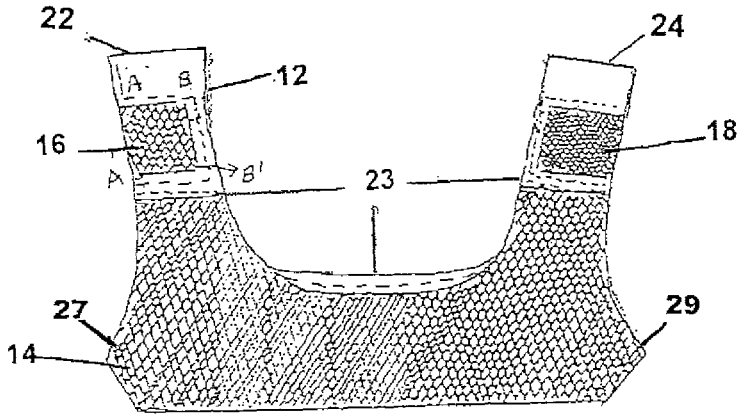
FIG. 2D
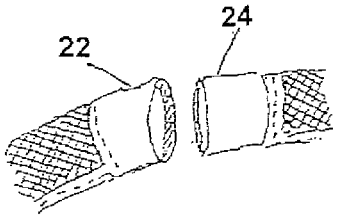
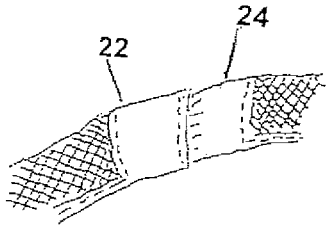
FIG. 2E

BASIC FORM FOR RYALL CAPS

BACKGROUND OF THE INVENTION

1. Field of the Invention

This invention relates generally to sleeping caps and in particular to a sleeping cap that lifts the face of a person away from the surface of a pillow to prevent the forming of facial wrinkles.

2. Description of Related Art

It is known that some people struggle to sleep on their backs and not on their sides because sleeping on the side creates wrinkles on the face. It is desirable to have a product which will lift a side of the face of a person away from the surface of the pillow while the person is sleeping on the side.

Back in the early 1960s, it is believed that the Shakers slept on their backs, and perhaps they were experimenting with this theory. On the worldwide web, there are pillows that claim to aid in anti-wrinkling. Therefore, many people seem to agree that there is a relationship between sleeping positions and wrinkles on the face. If you lie on your side and then look at your face in the mirror, you may agree with this theory.

U.S. Pat. No. 2,044,921 issued Jun. 16, 1936 to H. M. Weiland et al. discloses a combination chin strap and hair cap device. The hair cap helps the hair or wave set of a person in place and the elastic chin strap supports drooping and sagging muscles or tissues and will further effectively reduce double chins and eliminate tell-tale lines on a face. The device comprises a hair cap of open work fabrics including a crown portion and side pieces, and the chin strap is connected to the lower ends of the side pieces; however, the device does not lift the side of a person's face away from a pillow or bed sheet to prevent creating wrinkles on the face. There is only a netlike or open work fabric between the face and the pillow surface and it appears that the tightness of the net and the jaw strap pushes the cheek towards the nose and will cause the face to have wrinkles.

U.S. Pat. No. 2,696,007 issued Dec. 7, 1954 to F. R. Larkin et al. discloses a sleeping halo or cap secured to a head of a wearer comprising a resilient halo-shaped bun or annulus adapted to be secured substantially at the base of the skull cap of the wearer to prevent rolling of the head during sleep. The annulus is held in place preferably by means of suitable chin strings. However, this device provides no support of the neck to enable the wearer to sleep in comfort and uses narrow ties which are tied under the wearer's chin and are a source of discomfort by becoming too tight or choking the wearer.

Dermatologists assert that our facial expression causes the formation of a person's face. If a mere expression affects the face, surely when the heavy weight of the head is on the side of the face which is pressed against a pillow, it causes wrinkles to form and remain there when a person reaches a certain age. The wrinkles formed by the expression such as two vertical lines between the eyebrows also deepen when we sleep on our side.

Yet, it seems that people are not quite satisfied with the wrinkle resisting pillows available in the marketplace today. Therefore, the present invention is believed to solve this problem.

SUMMARY OF THE INVENTION

Accordingly, it is therefore an object of this invention to provide a sleeping cap that lifts a person's face from any surface while the person sleeps on either side.

It is an object of this invention to provide a sleeping cap in the form of a ring for stability and comfort of the wearer especially at the neck area.

It is another object of this invention to provide a foam rubber material in the basic form of the sleeping cap for comfort of the wearer.

It is a further object of this invention to provide straps for comfortably securing the sleeping cap on a wearer's head.

These and other objects are further accomplished by a ring-shaped sleeping cap comprising a U-shaped basic form having lower sides extended sideways including forming a point on each of said lower sides to extend toward a chin of a wearer and to be tucked in back of a wearer's ears, the U-shaped basic form includes a foam rubber material covered by a fabric, the fabric extending beyond the ends of each leg of the U-shaped basic form, a first extension of additional material being inserted and secured within the extended fabric adjacent to an end of a first leg of the U-shaped basic form, a second extension of the additional material being inserted and secured within the extended fabric adjacent to an end of a second leg of the U-shaped basic form, and the fabric at the end of the first extension is permanently attached to the fabric at the end of the second extension to form the sleeping cap having an open space in the center of the sleeping cap. The fabric comprises a cotton or a cotton blend material. The sleeping cap forms a ring shape when the fabrics at the ends of the first extension and the second extension are permanently attached together. A first strap is attached to a first lower end of the basic form, and a second strap is attached to an opposite second lower end of the basic form, the first strap and the second strap secure the sleeping cap to a lower portion of wearer's head, the first strap and the second strap being located under the wearer's chin.

The objects are further accomplished by a method of making a sleeping cap comprising the steps of providing a U-shaped basic form including a foam rubber material covered by a fabric, extending the fabric beyond the ends of each leg of the U-shaped basic form, positioning a first extensions of additional material flexibly in the fabric adjacent to an end of a first leg of the U-shaped basic form, positioning a second extension of additional material flexibly in the fabric adjacent to an end of a second leg of the U-shaped basic form, and attaching the fabric at the end of the first extension to the fabric at the end of the second extension to form the sleeping cap. The step of providing a U-shaped basic form covered by a fabric comprises the step of using a cotton or a cotton blend fabric. The step of forming the sleeping cap by attaching together the fabric of the first extension to the fabric of the second extension comprises the step of forming a ring-shaped sleeping cap. The method comprises the step of attaching a first strap to a first lower end of the basic form and attaching a second strap to an opposite second lower end of the basic form, the first strap and the second strap securing the sleeping cap to a wearer's head. The method further comprises the step of attaching a lace over the basic form of the ring-shaped sleeping cap.

Additional objects, features and advantages of the invention will become apparent to those skilled in the art upon consideration of the following detailed description of the preferred embodiments exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIG. 2A shows the basic form of FIG. 1A positioned within layers of fabric for forming a sleeping cap having the outer fabric cut away to show the basic form;

FIG. 2B shows the outer fabric of FIG. 2A removed and the addition of the foam rubber pieces inserted as upper extensions of the basic form of the sleeping cap;

FIG. 2D is a perspective view of the legs of the outer fabric covering the basic form positioned to be connected together;

FIG. 2E shows the legs of the outer fabric of FIG. 2D connected together;

DESCRIPTION OF ILLUSTRATIVE EMBODIMENT

Figure 3A:
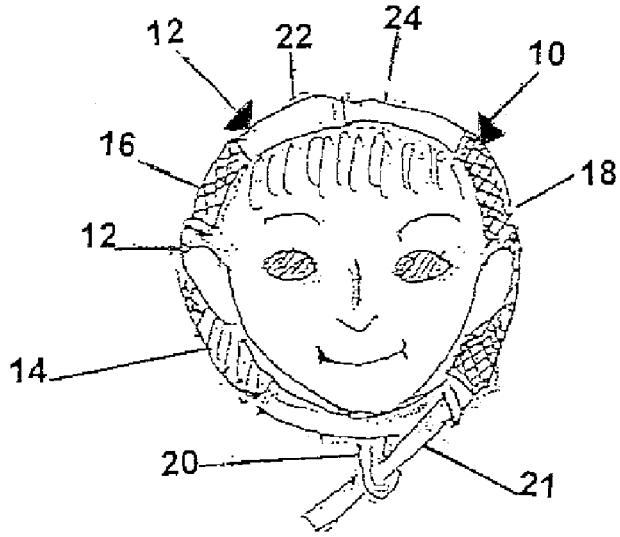
FIG. 3A is a front view of a sleeping cap positioned on a person's head with a portion of the outer fabric cut-away to show the basic form and extensions.
Figure 3B:
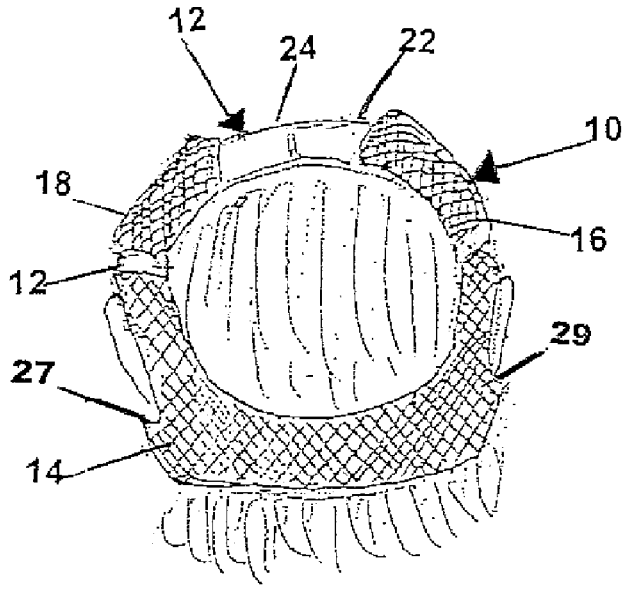
FIG. 3B is a rear view of a sleeping cap positioned on a person's head with a portion of the outer fabric cut-away to show the basic form and extensions.

Referring to the drawings and in particular FIGS. 3A and 3B, FIG. 3A is a front view of a sleeping cap 10 on a person's head with a portion of the outer fabric 12 removed to show the basic form 14, a first extension 16, and a second extension 18. Straps 20, 21 made from a fabric material, provide for securing the sleeping cap 10 to the person's head. FIG. 3B is a rear view of a sleeping cap positioned on the person's head with a portion of the outer fabric 12 cut-away to show the U-shaped basic form 14 along with the extensions 16, 18. The sleeping cap 10 lifts the face of the person away from a sleeping surface to prevent the face from being pressed against the sleeping surface such as a pillow and to prevent facial wrinkles.

The basic form 14 is used in making the sleeping cap 10, and it is approximately U-shaped with lower sides extended sideways. It is referred to as "basic form" because it may be used to make various embodiments of sleeping caps, and the various embodiments are referred to as "RYALL CAPS" (pronounced the same as the word "real") which is an acronym for Retaining Youthful And Lovely Look. When a fabric or cloth 26 is used to cover the basic form 14 by sewing, two rectangular pieces or extensions 16, 18 are added on top of the legs 17, 17 of the U-shaped basic form 14. Once the two rectangular extensions 16, 18 are added, the ends 22, 24 (FIG. 2A) of the fabric or cloth 26 are joined together by sewing, and the sleeping cap 10 looks like a ring. The basic form 14 and the extensions 16, 18 may be embodied by foam rubber or other similar cushion-like, resilient materials known in the art.

Still referring to FIGS. 2A and 3B, the ring of the sleeping cap 10 is designed so that the two legs 15, 17 of the U-shape basic form 14 will stay tucked in the back of the ears and the two small or rectangular extensions 16, 18 start above the ear extending to part of the forehead. The bottom portion of the U-shape basic form 14 rests on the back of the neck and extends to the start of a jaw line of the wearer. When the sleeping cap 10 is made with the foam rubber basic form 14, it may be attached securely to the head with combs, bobby pins, chin straps or eye-masks. Thus, the sleeping cap 10 withstands the toss and turns of the head, and a person's face will be prevented from pressing against the sleeping surface. A person's sleeping habit may change the position of the basic form 14. Sometimes it may cover the ear and, on rare occasion, even cover the face about 1" from the ear. Still, the sleeping cap 10 will not press into an individual's face and the face will always stay away at least ⅛" from any surface.

Figure 1A:
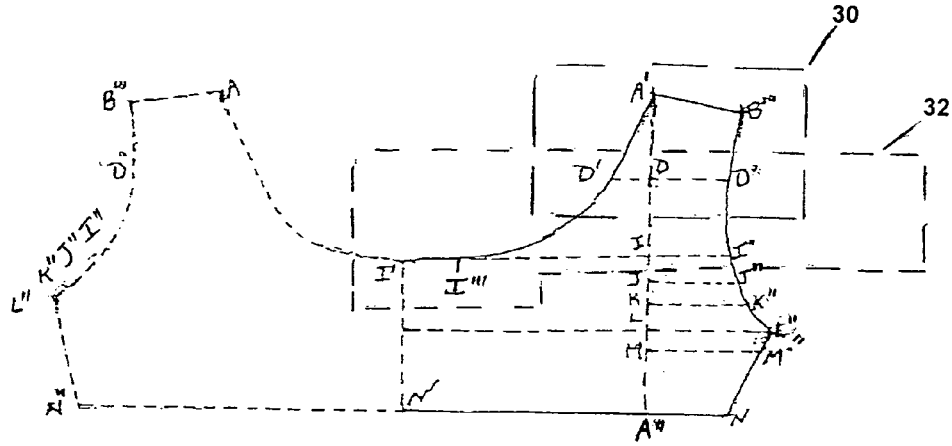
FIG. 1A is a pattern for cutting a fabric and a foam rubber to make a basic form of a sleeping cap according to the invention.
Figure 1B:
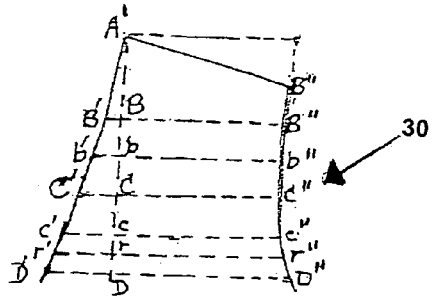
FIG. 1B shows an enlarged view of a first portion of FIG. 1A according to the invention.
Figure 1C:
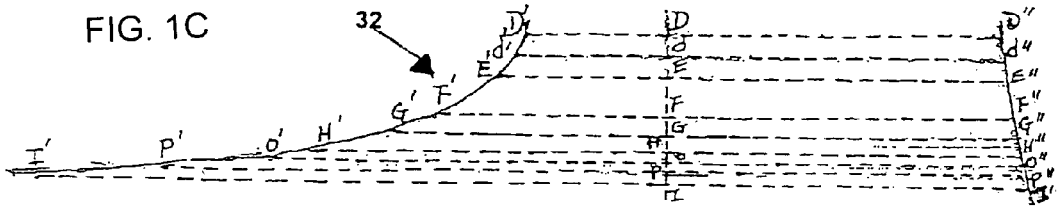
FIG. 1C shows an enlarged view of a second portion of FIG. 1A according to the invention.

Referring now to FIG. 1A, FIG. 1B, and FIG. 1C, FIG. 1 is a pattern for cutting a fabric and a foam rubber to make the basic form 14 of sleeping cap 10 according to the present invention. FIG. 1B shows an enlarged view of a first portion 30 of FIG. 1A, and FIG. 1C shows an enlarged view of a second portion 32 of FIG. 1A. The reference letters in the drawings provide points for measuring distance in inches which are provided for a preferred embodiment as listed in Tables 1 and 2. Table 1 provides distances for reference points in FIGS. 1A, 1B and 1C, and Table 2 provides distances for reference points in FIG. 2C. One of ordinary skill in the art will recognize that many modifications to the distances for reference points in Tables 1 and 2 may be made to implement various size sleeping caps in accordance with the scope of this invention.

A method of making or constructing the basic form 14 for the sleeping cap 10 comprises the steps of:

(a) obtaining one-half yard of woven cotton or cotton blend broad cloth;

TABLE 1

| | | | |
|---|---|---|---|
| A-A" = 6 5/16" | A-A' = 2⅛" | A'-B"' = ½" | A-B"' = 2⅛" |
| A-B = 1" | A-C = 2" | A-D = 3" | A-I = 4" |
| A-K = 5" | A-M = 6" | B-B' = 3/16" | B-B" = 2 1/32" |
| B-b = ½" | b-b' = 5/16" | b-b" = 1 31/32" | C-C' = 7/16" |
| C-C" = 1 15/16" | C-c = ½" | c-c' = 9/16" | c-c" = 1 15/16" |
| c-r = ¼" | r-r' = ⅝" | r-r" = 1 15/16" | D-D' = ¾" |
| D-D" = 1 31/32" | D-d = ⅛" | d-d' = ⅞" | d-d" = 1 31/32" |
| D-E = ⅛" | E-E' = 1" | E-E" = 2" | E-F = ¼" |
| F-F" = 1½" | F-F" = 2 1/32" | F-G = 3/16" | G-G' = 2 3/16" |
| G-G" = 2 1/16" | G-H = 1/16" | H-H' = 2⅝" | H-H" = 2 3/32" |
| H-O = 1/16" | O-O' = 3" | O-O" = 2 3/32" | O-P = 1/16" |
| P-P' = 3⅝" | P-P" = 2⅛" | P-I"' = ⅜" | I"'-I' = 1/18" |
| I-I' = 4" | I-I" = 25/32" | I-J = ½" | J-J" = 2 5/16" |
| K-K" = 2⅝" | K-L = ⅜" | L-L" = 2⅞" | M-M" = 2 7/16" |
| A"-N = 2¼" | N-N' = 6¼" | N-N"' = 12½" | I"'-N = 2⅜" |

TABLE 2

| | |
|---|---|
| A-A' = B-B' = 3¼" | A-B = A'-B' = 2" |

(b) obtaining a one-inch thick piece of foam rubber of normal density measuring approximately 45 inches by 16 inches;

(c) cutting the foam rubber to the size and shape in accordance with the pattern of FIG. 1A and dimensions in Table 1.

Figure 2C:
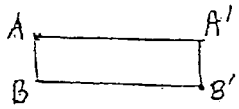
FIG. 2C shows a piece of foam rubber used in the upper extensions of the basic form as shown in FIG. 2B.

(d) cutting two pieces 16, 18 of foam rubber to the size and shape in accordance with the pattern of FIG. 2C and dimensions in Table 2.

(e) cutting two pieces of the cloth to have a size and shape as illustrated in FIG. 2A which is accomplished by adding approximately one inch larger all around to the pattern of FIG. 1A and extending the cloth legs 22, 24 to be approximately seven inches above the ends of the legs 15, 17 of the basic form 14.

(f) sewing the two pieces of cloth from step e together approximately ⅜ inches from the edge but leaving open the inner edge marked 23 in FIG. 2A.

(g) turning inside-out the cloth 16 of step f and inserting foam rubber cut in step 3 through the opening 23 in cloth 26.

(h) Inserting the two pieces 16, 18 of foam rubber into the legs 22, 24 of cloth 26 and positioning the narrow ends of the pieces 16, 18 facing the ends of the legs 15, 17 of the basic form 14.

(i) Sewing the edge opening 23 of the cloth 26 as illustrated in FIG. 2B.

(j) Sewing the ends of the legs 22, 24 of cloth 26 together as illustrated in FIG. 2D and FIG. 2E by folding one end 22 by one-half inch, inserting the other end 24 through the folded end 22, and sewing ends 22 and 24 together to make the basic form 14 with fabric or cloth 26 into a ring shape, as shown in FIG. 3A and FIG. 3B.

Referring to FIG. 3A, the sleeping cap 10 is secured to a person's head by straps 19, 21. The first strap 19 is attached to one side of the sleeping cap 10 and the second strap 21 is attached to the other side. A loop 20 hangs from strap 19 for receiving strap 21, and a buckle 25 is positioned near an end of strap 19 for receiving strap 21. The straps 19, 21 may be embodied by a commonly available material for ease of sliding through the buckle 25.

Figure 4A:
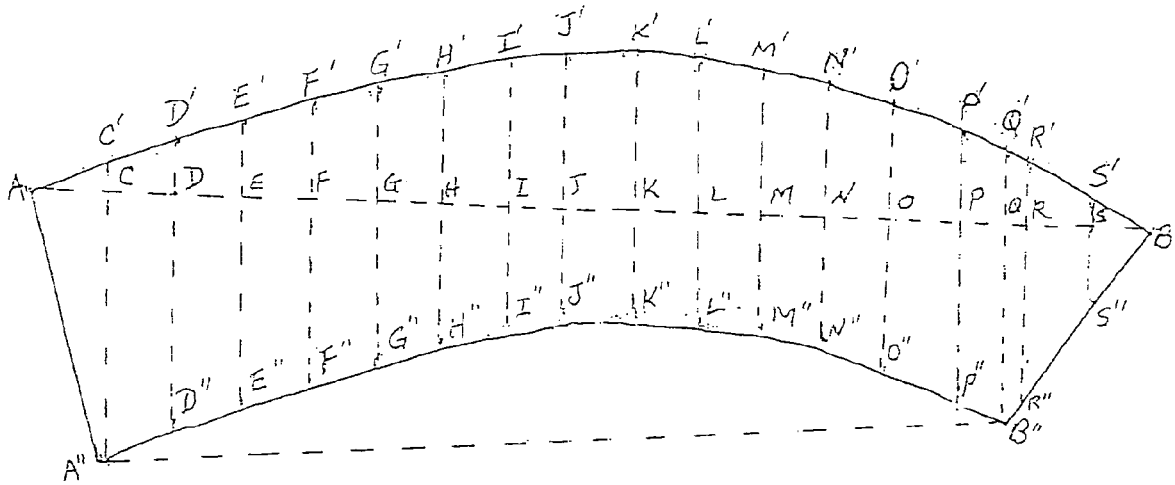
FIG. 4A is a diagram of a pattern for cutting a first section of a cover fabric for the sleeping cap.
Figure 4B:
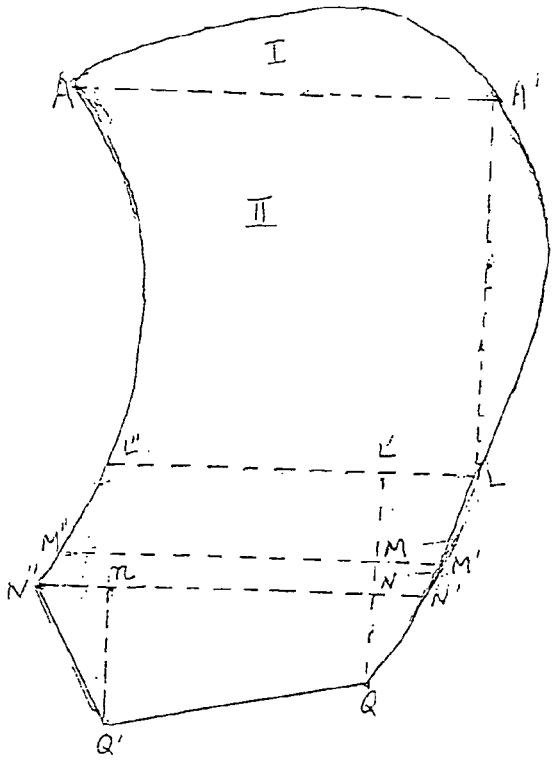
FIG. 4B is a diagram of a pattern for cutting a second section of the cover fabric for the sleeping cap.

Referring to FIG. 4A and FIG. 4B, FIG. 4A is a diagram of a pattern for cutting a first section of a cover fabric, such as commonly known lace material, for the sleeping cap 10, and FIG. 4B is a diagram of a pattern for cutting a second section of the cover fabric for the sleeping cap 10. The first section is matched and sewn to the second section of cover fabric forming a cover for positioning over the top of the ring of the sleeping cap 10.

This invention has been disclosed in terms of a preferred embodiment. It will be apparent that many modifications can be made to the disclosed sleeping cap without departing from the invention. Therefore, it is the intent of the appended claims to cover all such variations and modifications as come within the true spirit and scope of this invention.

The invention claimed is:

1. A ring-shaped sleeping cap comprising:

a U-shaped basic form having lower sides extended sideways including forming a point on each of said lower sides to extend toward a chin of a wearer and to be tucked in back of said wearer's ears, said U-shaped basic form includes a foam rubber material covered by a fabric, said fabric extending beyond the ends of each leg of the U-shaped basic form;

a first extension of said foam rubber material being inserted and secured within said extended fabric adjacent to an end of a first leg of said U-shaped basic form;

said first extension of said foam rubber material is flexibly attached to said first leg of said U-shaped basic form;

a second extension of said foam rubber material being inserted and secured within said extended fabric adjacent to an end of a second leg of said U-shaped basic form;

said second extension of said foam rubber material is flexibly attached to said second leg of said U-shaped basic form; and said fabric at the end of said first extension is permanently attached to said fabric at the end of said second extension to form said ring-shaped sleeping cap having an open space in a center of said sleeping cap.

2. The sleeping cap as recited in claim 1 wherein said fabric comprises a cotton or a cotton blend material.

3. The sleeping cap as recited in claim 1 wherein a first strap is attached to a first lower end of said basic form and a second strap is attached to an opposite second lower end of said basic form, said first strap and said second strap secure said sleeping cap to a lower portion of a wearer's head, said first strap and said second strap being located under said wearer's chin.

4. The sleeping cap as recited in claim 3 wherein said sleeping cap comprises a loop attached to said first strap and a buckle at an end of said first strap for receiving said second strap thereby enabling said sleeping cap to be secured to a wearer's head.

* * * * *